US006205616B1

(12) United States Patent
Hwang

(10) Patent No.: US 6,205,616 B1
(45) Date of Patent: Mar. 27, 2001

(54) PIVOTAL BEARING FOR DOOR FRAMES

(75) Inventor: James Hwang, Taipei (TW)

(73) Assignee: Kenmark Industrial Co., Ltd., Taipei (TW)

( * ) Notice: Subject to any disclaimer, the term of this patent is extended or adjusted under 35 U.S.C. 154(b) by 0 days.

(21) Appl. No.: 09/346,744

(22) Filed: Jul. 2, 1999

(30) Foreign Application Priority Data

Jul. 15, 1998 (TW) ..... 87211373

(51) Int. Cl.[7] ..... E05D 7/10
(52) U.S. Cl. ..... 16/229
(58) Field of Search ..... 16/229–232; 49/403

(56) References Cited

U.S. PATENT DOCUMENTS 665,603 * 1/1901 Henry ..... 16/229
1,328,874 * 1/1920 Henault ..... 16/229
2,186,789 * 1/1940 Rosengerg ..... 16/229
2,249,329 * 7/1941 Rosengerg ..... 16/229
2,369,148 * 2/1945 Langhorst ..... 16/229
2,379,528 * 7/1945 Kelliher ..... 16/229
4,620,392 * 11/1986 Kerpers et al. ..... 16/229
5,490,305 * 2/1996 Domingo Ribot ..... 16/229

* cited by examiner

*Primary Examiner*—Chuck Y. Mah
(74) *Attorney, Agent, or Firm*—Bacon & Thomas, PLLC

(57) ABSTRACT

The present invention is about an improved pivot bearing for door frames with a spring installed within, such that a protruding pivotal portion is made elastic, facilitating easy assembly of shelves and cabinets. In assembling shelves and cabinets, various boards are connected first, only thereafter are the door frames, equipped with the pivotal bearing of the present invention, installed in place. In this manner, the assembly of shelves and cabinets is made easier, fulfilling the purpose and object of Do-It-Yourself design.

1 Claim, 3 Drawing Sheets

PIVOTAL BEARING FOR DOOR FRAMES

FIELD OF THE INVENTION

This present invention relates to a pivotal bearing for door frames; especially to a pivotal bearing suitable for use in self-assembly shelves and cabinets, which should facilitate the ease and efficiency of such assembly by users.

DESCRIPTION OF THE PRIOR ART

In the current furniture market, many shelves and cabinets require the purchasing users to perform the assembly, this is the so-called "DIY" (Do It Yourself).

For the suppliers, the DIY design tends to reduce the storage space, facilitate easy transportation, and lower the cost for assembly. In the DIY design, whether the manner of assembly, namely, the procedural steps involved in the assembly, can be easily followed by the purchasing users is an important consideration. Therefore, any improvement in making the assembly easier to accomplish not only is a high priority in the DIY design, but also can increase the efficiency of preliminary assembly at the production lines.

FIG. 1 shows a side view of the conventional pivotal bearing for door frames. The fixing portion 11 of the conventional pivotal bearing 1 is used for fixing to the door; and a protruding pivotal portion 12, installed on top of the fixing portion 11, acts as a pivot for the door. FIG. 2 shows the conventional procedural steps for assembling shelves and cabinets: the top board 52, side board 51, and the bottom board 53 are usually jointed together via the use of tenons 511, 512, and the mortice 521, 522, and 523. However, in assembling the cabinet door 50 installed with a pivotal bearing having a protruding pivot 12 on top, the door 50, side board 51, and the bottom board 53 must be jointed together before the top board 52 is to be installed in place. In installing the top board 52, the user must aim the protruding pivot 12 of the pivotal bearing 1, and the two tenons 511, 512 of the side board accurately with respect to the mortice of 522, 521, and 523 of the top board 52 respectively to effect proper jointing, an task not easy for most users. Especially in assembling a shelve or cabinet, an user is faced with the task of jointing the two symmetrical doors with the top board by pivotal bearings, and jointing of the side boards with the top board by tenons and mortice simultaneously. The fact that the two doors are free to swing via the bearings on top of the bottom board 53 makes the insertion of the protruding pivotal portion 12 of the pivotal bearing 1 into the mortise 523 of the bottom board 52 less easy to accomplish. Furthermore, subsequent to the assembly of the shelves and cabinets, the door 50 becomes difficult to remove, because the top board 52 must be removed first, making it inconvenient for the user.

Use of the conventional pivotal bearing 1 entails the cumbersome manner of board jointings, as described above, in the assembly process. Therefore, the present invention devises an improved pivotal bearing for door frames with elastic pivot, furthering the industrial utility and practicality.

The object of the present invention is to provide a pivotal bearing for door frames with a elastic pivot.

An alternative object is to provide a pivotal bearing for door frames which facilitates the assembly of shelves and cabinets.

SUMMARY OF THE INVENTION

In view of the fact that the installation of the conventional pivotal bearings for door frames makes the assembly of shelves and cabinets cumbersome, less efficient, and the removal of door frames, once installed, difficult to accomplish, the present invention seeks to improve upon the conventional pivotal bearings, such that the fixing portion is equipped with a spring inside, so as to render elasticity to the protruding pivotal portion and facilitate ease to the assembling process. The respective boards may be jointed with one another first, then the door frames equipped with the pivotal bearings of the present invention may be installed into positions, so that the ease of assembly is increased, and the purpose and function of the DIY design fulfilled.

| Numbering Scheme | |
|---|---|
| Conventional pivotal bearing for door frames | 1 |
| Pivotal bearing for door frames of the present invention | 2,3 |
| Fixing portion | 11,21,31 |
| Protruding pivotal portion | 12,22,23 |
| Spring | 23 |
| Lever | 322 |
| Pulling portion | 323 |
| Door frame | 50 |
| Side board | 51 |
| Top board | 52 |
| Bottom board | 53 |
| Protruding tenons | 511,512 |
| Mortice | 521,522,523 |

DETAILED DESCRIPTION OF THE INVENTION

Figure 1:
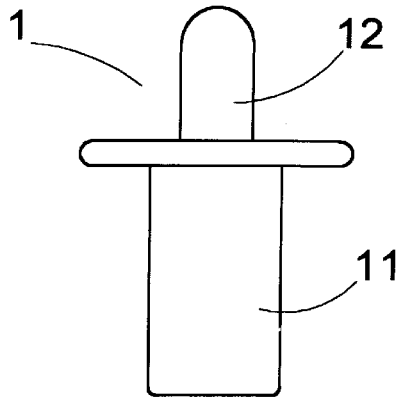
FIG. 1. A side view of the conventional pivotal bearing for door frames.
Figure 2:
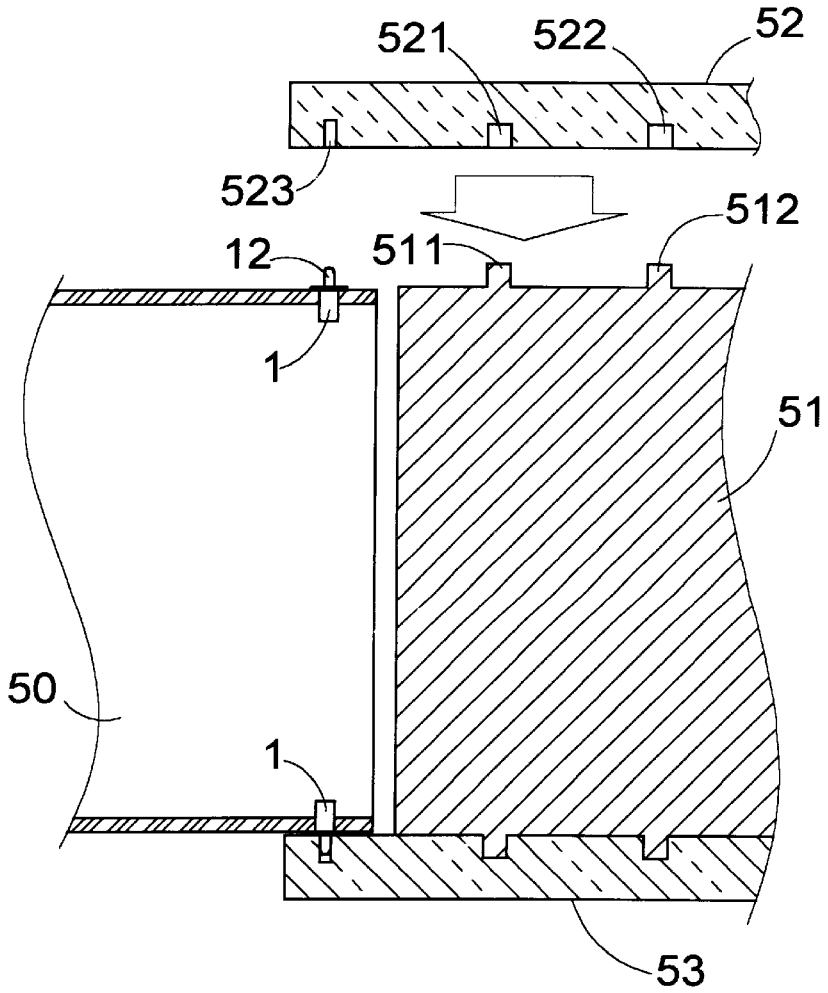
FIG. 2A. The conventional process of assembling shelves and cabinets.
Figure 3A:
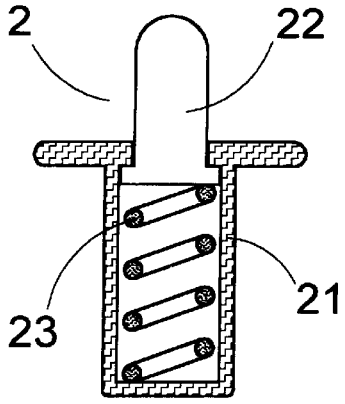
FIG. 3A. A cross-sectional view of the pivotal bearing for door frames of the present invention.

Referring to FIG. 3A, which shows a cross-sectional view of the pivotal bearing for door frames of the present invention, the pivotal bearing 2 having a hollow fixing portion 21, a spring 23 is lodged therewith; and a protruding pivotal portion 22 having side wings at its bottom such that when the spring 23 pushes the protruding pivotal portion 22 upwards, said side wings can hold the protruding pivotal 22 in place.

Figure 3B:
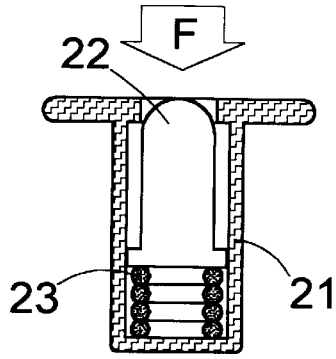
FIG. 3B. A cross-sectional view of the pivotal bearing for door frames shown in FIG. 3A in another state.

Referring to FIG. 3B, which shows a cross-sectional view of the pivotal bearing in a separate state, as a force F exerts on the protruding portion 22, it may be pushed into the hollow shaft of the fixing portion 21, and compresses the spring 23. When the force F is removed, the pivotal bearing restores to its former position shown in FIG. 3A.

Figure 4:
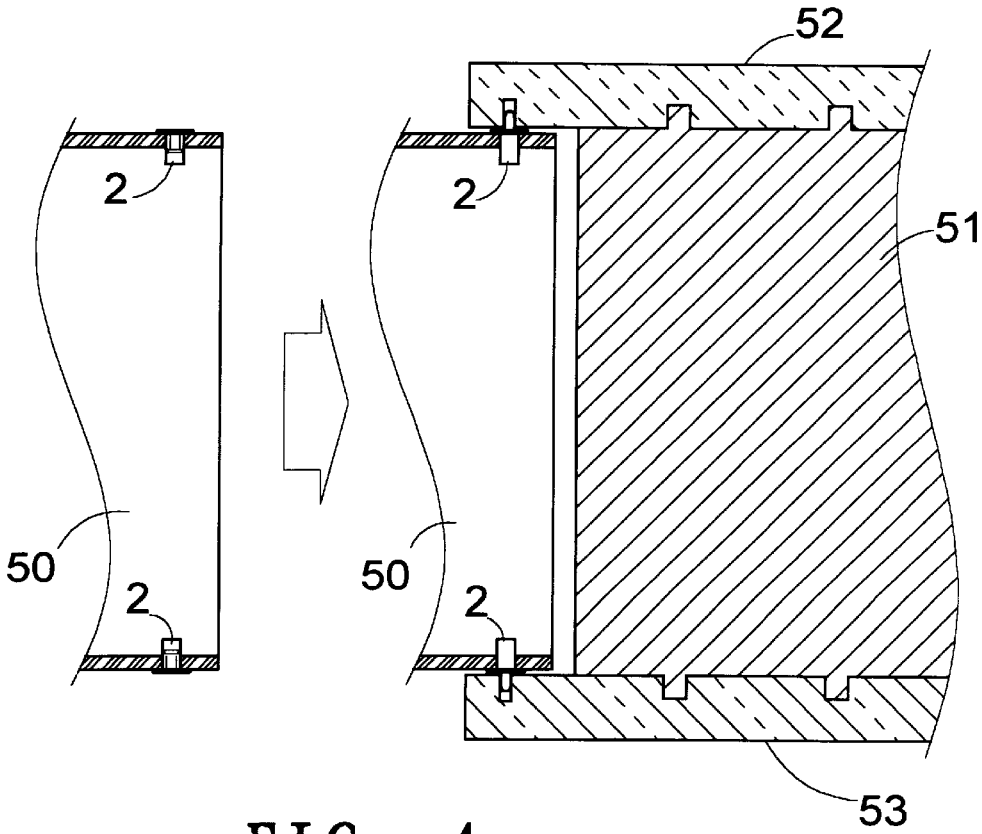
FIG. 4. The process of assembling shelves and cabinets with the use of the pivotal bearing for door frames of the present invention.

FIG. 4 shows the process of assembling shelves and cabinets with the use of the pivotal bearing of this invention.

By virtual of the elastic protruding pivotal portion 22 of the pivotal bearing 2, the order of assembling steps may be changed. The two side boards may directly joint with the top board 52 and the bottom board 52 first. The side board 51 may be fixed on the bottom board 52 first. And as the mortice 521, 522 of the bottom board 52 and tenons 511, 512 of the side board 51 are matching pairs, the top board may joint to the side boards with greater ease. Thereafter, both doors may separately be installed into their respective places. In installing door-frame 50, the protruding pivotal portion 22 of the pivotal bearing 2 can be depressed into the fixing portion and as the door-frame 50 is brought into place, said protruding pivotal portion 22, by virtual of the elasticity provided by the spring 23, will be thrust and inserted into either mortise of the top board 52 or bottom board 53.

Figure 5A:
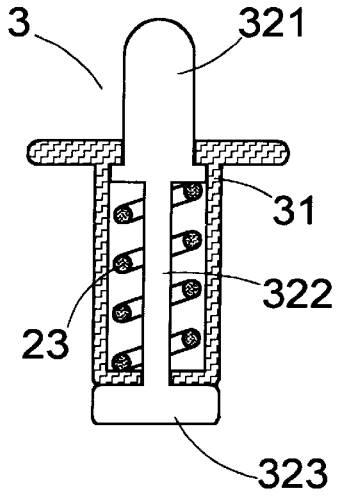
FIG. 5A. A cross-sectional view of the pivotal bearing for door frames of the present invention in another instance of embodiment.

Referring to FIG. 5A, a cross-sectional view of another instance of pivotal bearing of the present invention. The pivotal bearing 3 of the present invention has a hollow fixing portion 31, wherein a spring 23 contained therewith; and a protruding pivotal portion 321, from the bottom of which, an elongated body is extended, and through the fixing portion 31, and forms as a pulling handle 323, said pulling handle 323 can help keeping the protruding pivotal portion 321 in place.

Figure 5B:
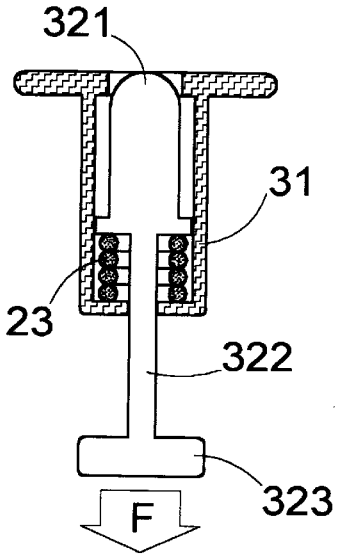
FIG. 5B. A cross-sectional view of the pivotal bearing for door frames of FIG. 5A in another state.

Referring to FIG. 5B, a cross-sectional view of the pivotal bearing shown in FIG. 5A in a separate state, when pulling handle 323 is being pulled by a force F, the protruding pivotal portion 321, which is integrally connected with the pulling handle, will be pulled into the hollow shaft of the fixing portion 31, and compresses the spring 23. When the pulling force F is removed, pivotal bearing 3 will revert to its former position shown in FIG. 5A.

Figure 6:
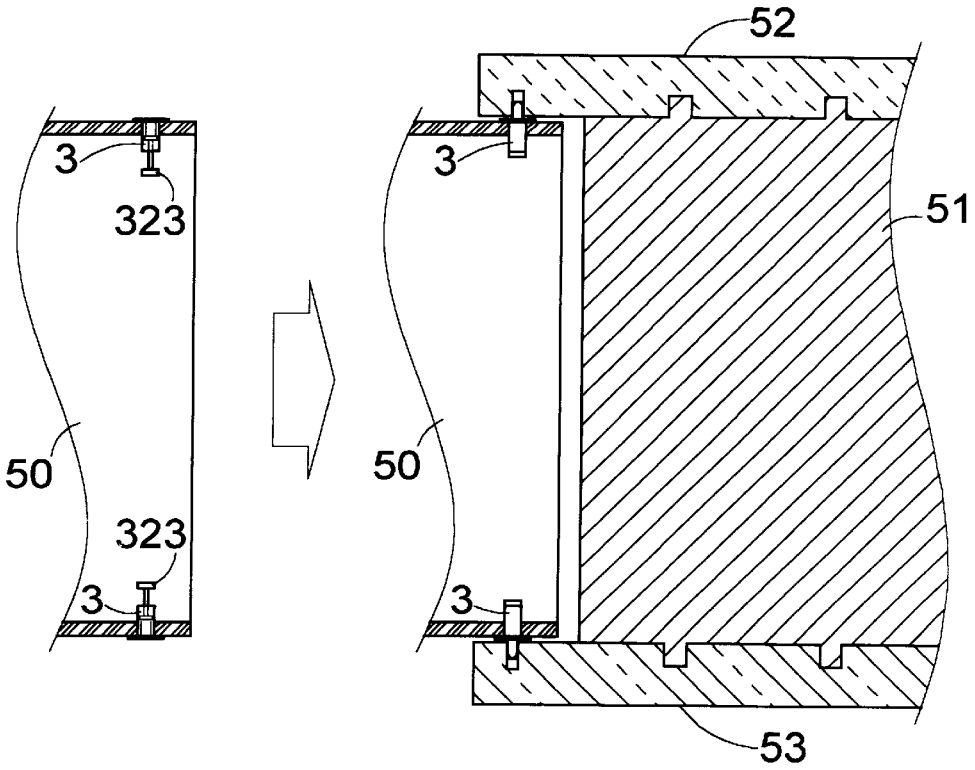
FIG. 6. The process of assembling shelves and cabinets using the pivotal bearing for door frames of FIG. 5A.

FIG. 6 shows the process of assembling shelves and cabinets using the pivotal bearing shown in FIG. 5A. By virtual of the elastic protruding pivotal portion of the pivotal bearing 3, the assembly is made easier. Just as in the previous mode of embodiment, various boards may be jointed together first. And prior to installing door frame 50, a pulling force F can be applied to handle 323 of the pivotal bearing 3, so that the protruding pivotal portion 321 is pulled inside the fixing portion 31, and as the door frame 50 is brought into place, the protruding pivotal portion 321 thrusts into either mortise of the top board 52 or bottom board 53 by virtual of the spring force 23, and completes the pivotal bearing connection. When the user wishes to remove the door frame, simply by pulling down the pulling portion 323 so that the protruding pivotal portion 321 is pulled out of the mortise, and thereby removes the doorframe easily.

After a detailed description of the preferred embodiment of the present invention, those skilled in the prior art may undertake further modifications and improvements within the scope and the spirit of the claims of this invention. Neither is this present invention restricted to the modes of preferred embodiment as described in this specification.

EFFECTIVENESS OF THE INVENTION

By using the pivotal bearing of the door frame of the present invention, the drawbacks of the conventional pivotal bearing may be effectively eliminated, the ease and efficiency of assembly procedures improved, and greatly enhancing users' ability to assemble with ease, fulfilling the aim of DIY concept.

In summary, this present invention has many superior features, solving many drawbacks and inconveniences associated with the application of the prior art, thereby achieving values of novelty and economical efficiency. As such, it meets the statutory requirements for a patent of utility model. A request is made to your esteemed Bureau for the issuance of a patent so that our rights may be properly protected. Your benevolence to the needs of people is duly noted and appreciated.

What is claimed is:

1. A pivotal bearing adapted for a doorframe bearing connection, which comprises:

a fixing portion adapted to be fixed on a doorframe, said fixing portion containing therein a spring, and a protruding bearing portion which can be brought inside said fixing portion by compressing said spring and wherein an elongated body extends from a laterally outward extending flange at the bottom of said protruding bearing portion, through said fixing portion, to form a pulling handle for compressing said spring and bringing said protruding bearing portion inside said fixing portion.

* * * * *